US011220415B2

(12) United States Patent
Stapensea

(10) Patent No.: US 11,220,415 B2
(45) Date of Patent: Jan. 11, 2022

(54) LIFTING SYSTEM WITH LOCK POSITION SENSOR FOR LOAD INDICATION, AND METHOD THEREFOR

(71) Applicant: Stertil B.V., Kootstertille (NL)

(72) Inventor: Jan Bernhard Stapensea, Sint Annaparochie (NL)

(73) Assignee: Stertil B.V., Kootstertille (NL)

( * ) Notice: Subject to any disclaimer, the term of this patent is extended or adjusted under 35 U.S.C. 154(b) by 313 days.

(21) Appl. No.: 16/274,686

(22) Filed: Feb. 13, 2019

(65) Prior Publication Data

US 2019/0248634 A1 Aug. 15, 2019

(30) Foreign Application Priority Data

Feb. 14, 2018 (NL) ..... 2020438

(51) Int. Cl.

| | |
|---|---|
| ***B66F 1/02*** | (2006.01) |
| ***B66F 5/02*** | (2006.01) |
| ***B66F 7/28*** | (2006.01) |
| ***B66F 5/04*** | (2006.01) |
| ***B66F 3/46*** | (2006.01) |
| ***B66F 17/00*** | (2006.01) |

(52) U.S. Cl.

CPC ..... *B66F 1/02* (2013.01); *B66F 3/46* (2013.01); *B66F 5/02* (2013.01); *B66F 5/04* (2013.01); *B66F 7/28* (2013.01); *B66F 17/006* (2013.01); *B66F 2700/025* (2013.01)

(58) Field of Classification Search

CPC ..... B66F 1/02; B66F 3/46; B66F 5/02; B66F 5/04; B66F 7/28; B66F 17/006; B66F 2700/025

USPC ..... 254/122–126, 89; 269/17

See application file for complete search history.

(56) References Cited

U.S. PATENT DOCUMENTS

| | | | | |
|---|---|---|---|---|
| 6,634,461 | B1 * | 10/2003 | Baker | B66F 3/46 187/210 |
| 9,334,145 | B2 * | 5/2016 | Fagan | B66F 7/10 |
| 2006/0182563 | A1 | 8/2006 | De Jong et al. | |
| 2011/0037041 | A1 * | 2/2011 | DeJong | B66F 3/46 254/89 R |
| 2015/0232309 | A1 * | 8/2015 | Jaipaul | B66F 7/04 414/800 |
| 2016/0016768 | A1 * | 1/2016 | Karleskint | B66F 17/00 254/133 R |

FOREIGN PATENT DOCUMENTS

| | | |
|---|---|---|
| EP | 0566195 B1 | 7/1997 |
| JP | 2012115986 A | 6/2012 |

* cited by examiner

*Primary Examiner* — Lee D Wilson

(74) *Attorney, Agent, or Firm* — The Webb Law Firm

(57) ABSTRACT

Disclosed is a lifting device, lifting system and method for lifting a vehicle. The lifting device includes a frame with a moveable carrier that is configured for carrying the vehicle; a drive which acts on the carrier and is configured for raising and/or lowering the carrier relative to the frame; a height sensing system that is configured for directly and/or indirectly measuring the height of the carrier; and a locking mechanism for mechanically locking the carrier at a desired height, including a moveable locking element capable of locking and unlocking the carrier. The locking mechanism includes a lock sensor for measuring the position of the locking element.

19 Claims, 10 Drawing Sheets

LIFTING SYSTEM WITH LOCK POSITION SENSOR FOR LOAD INDICATION, AND METHOD THEREFOR

CROSS-REFERENCE TO RELATED APPLICATION

This application claims priority to Dutch Patent Application No. 2020438 filed Feb. 14, 2018, the disclosure of which is hereby incorporated by reference in its entirety.

BACKGROUND OF THE INVENTION

Field of the Invention

The invention relates to a lifting system, more specifically a vehicle lifting system, that is provided with a locking mechanism. In general, lifting systems are specifically used for lifting passenger cars, trucks, busses, or other vehicles and may involve a system comprising one or more moveable lifts or lifting devices, such as (mobile) lifting columns, lifting columns of the two-post lift type with pivoting support arms, the four-post lift type with runways, in-ground lifts etc.

Description of Related Art

Conventional lifting systems comprise a frame with a carrier that is connected to a drive for moving the carrier upwards and downwards. In the ascent mode, hydraulic oil is pumped to a cylinder for lifting the carrier and, therefore, the vehicle. In the descent mode, the carrier with the vehicle is lowered and hydraulic oil returns to the reservoir. For example, such prior art lifting system is disclosed in U.S. Patent Application Publication No. 2006/0182563, which is incorporated herein by reference. Such lifting system comprises a mechanical safety ratchet system as a locking mechanism for mechanically preventing an undesired relative movement of a carrier to a frame of the lifting device. A conventional ratchet system is disclosed in EP 0 566 195 B1, which is incorporated herein by reference. Without a mechanical ratchet or locking system undesired movements may be caused by a disturbance in the hydraulic system of the lifting device. The ratchet system uses a stop frame and ratchet or locking element to prevent such movement. Pressure sensors can be used to determine the load acting on the hydraulic system and indicating the state of the mechanical locking system.

A problem that occurs is that the hydraulic system of a lifting system is relieved when using axle stands, for example. This may provide incorrect indications of a safe operating condition that may lead to accidents.

An object of the invention is to improve the safety when working with lifting systems and to obviate or at least reduce one or more of the aforementioned problems.

SUMMARY OF THE INVENTION

This object is achieved with a lifting system for lifting a vehicle according to the invention, the lifting system comprising:

- a frame with a moveable carrier that is configured for carrying the vehicle;
- a drive which acts on the carrier and is configured for raising and/or lowering the carrier relative to the frame;
- a height sensing system that is configured for directly and/or indirectly measuring the height of the carrier;

- a locking mechanism for mechanically locking the carrier at a desired height comprising a moveable locking element capable of locking and unlocking the carrier, wherein the locking mechanism comprises a lock sensor for measuring the position of the locking element.

The lifting system according to the invention specifically relates to a vehicle lifting system using a number of lifting devices, including lifting columns, mobile lifting columns, lifting columns of the two-post lift type with pivoting support arms, the four-posts lift type with runways, in-ground lifts, for example. In the context of the present invention the carrier relates to the moving parts of the lifting device when lifting the vehicle. This carrier is driven by a drive, such as a hydraulic drive, pneumatic drive and/or electric drive.

By providing a height sensing system the height of the carrier relative to the frame and/or ground surface can be detected/measured. This measurement can be done directly with a pull wire potentiometer or alternatively with a laser sensor or indirectly with an ultrasonic oil level sensor in the tank of the hydraulic system. It will be understood that other height measuring or sensing systems can also be used.

The mechanical locking mechanism locks the carrier at a desired height to provide a safe working environment. In a presently preferred embodiment such mechanism involves a safety ratchet device having a series of successive stop elements in the longitudinal direction of the frame that define a lock or stop surface, and a locking element to which is also referred to as a ratchet element, that may come into contact with a stop element in a locking position. In an unlocking or retracted position the stop elements can pass freely relative to the locking element. The locking element can be activated after the carrier or carriers of the lifting device or devices have reached the desired height. In a presently preferred embodiment the locking element comprises a locking pawl. Such pawl provides a stable and robust locking element.

According to the invention the locking mechanism comprises a lock sensor for measuring the position of the locking element. By directly measuring the actual position of the locking element the locking or unlocking state of the mechanism is determined directly. This provides a safe locking mechanism that provides safety indications correctly under a much broader range of operating conditions as compared to conventional mechanisms. For example, when using axle stands the load is actually removed or at least its weight is largely reduced from the carrier or carriers and the load is moved to the stands. This may give a lifting controller the impression that the load is safely supported by the locking mechanism, such that a safe working environment is achieved. This is not necessarily true and depends on the axle stands, for example. In a worse case scenario, this may even result in accidents due to the false detection of a safe working environment. Providing a direct lock sensor that directly measures the actual position of the locking element enables a direct detection of the actual status of the locking mechanism. This obviates any false detections such that a safe working environment can be achieved. This improves the overall safety of working with a lifting device for lifting a vehicle.

The lock sensor preferably comprises a position indicator that may operate (electro)mechanically, inductive or optically. It will be understood that different types of lock sensors can be applied for the direct measurement of the actual position of the locking element.

In a preferred embodiment of the invention the sensor is connected with a connector to the control system of the lifting device, so that the actual status of the lock sensor can be indicated on the control panel, preferably on a display thereof.

By providing a display, an operator of the lifting device is provided with an overview of the actual status of the lifting device, more specifically in relation to the actual position of the locking element. The display can be one or more of a display of the lifting device such as a touch screen, a display on a remote control, or a central display that is capable of visualizing the status of locking elements of different lifting devices.

Visualisation of the actual status of the locking elements or unlocking elements can be done in various ways. For example, a green screen or green element can be displayed when the locking element or locking elements are in the locking position, such that all the carriers are supported by the locking element, such as the locking pawl. In presently preferred embodiments this means that the lifting device or lifting system has reached its desired height and the carriers are brought into a position that a mechanical locking system is activated, for example by a user. In the visualisation a red background colour or element may indicate that the locking element or pawl is inactive and is in a retracted position. In an intermediate situation, the background colour or element colour can be orange indicating that the locking element or pawl is in an active locking state, however, the locking pawl is not yet activated in this state. Optionally, in addition, visualization may also use a light element attached or connected to the lifting device or at another location, for example centrally in the work place. Furthermore, in addition to any visual indication, also a sound signal can be used to improve the message or signal to the operator. Furthermore, in addition or as an alternative to the sound signal, a signal can be provided to a supervisor to enable this supervisor to check that working conditions are safe.

In a further preferred embodiment of the invention the lifting device further comprises a controller that is connected to the lock sensor and is configured to enable and or disable the operation of the lifting device based on a signal received from the lock sensor.

By providing the controller with the measurement signal from the lock sensor the controller is capable of detecting a safe or unsafe situation. The controller may provide warning signals and may also enable and/or disable operation of the lifting device or lifting system as a whole. This contributes to the safety of the working environment.

In one of the preferred embodiments the controller further comprises a warning system that is configured for comprising a warning signal and/or control signal in response to a detected and unsafe situation. This further improves the overall safety when working with a lifting device or lifting system.

In a further preferred embodiment of the invention the lifting device comprises a vehicle detector. By providing such vehicle detector the lifting device is capable of detecting the presence of a vehicle. This can be used by a controller, for example, and may improve the overall safety when working with a lifting device or lifting system.

The invention further also relates to a lifting system for lifting a vehicle, wherein the lifting system comprises one or more lifting devices according to the present invention.

Such lifting system provides the same effects and special advantages as described for the lifting device.

In a preferred embodiment the lifting system comprises a central display that is configured for displaying the status of one or more locking elements of the one or more lifting devices. Providing such central display provides an operator with an overview of all lifting devices included in the lifting system.

The lifting system is further preferably provided with a central controller that is preferably operatively connected to the one or more locking sensors and is capable of determining the safety when working with the lifting system. Preferably, the sensor controller is configured to enable or disable the actual position(s) of the locking element(s).

The invention also further relates to a method for lifting a vehicle, the method comprising the steps of:

- providing a lifting device and/or lifting system according to an embodiment of the invention;
- measuring the position of the locking element with the locking sensor;
- determining the status of the locking mechanism and providing the status to a display; and
- displaying the status of the locking mechanism.

Such method provides the same effects and/or advantages as described for the lifting device and/or the lifting system.

Preferably, the method further comprises the step of enabling and/or disabling operation of the lifting device and/or lifting system and after enabling of the lifting operation, the actual lifting of the vehicle. This improves the overall safety when lifting a vehicle.

In a further preferred embodiment of the invention the method further comprises the step of detecting an unsafe situation and providing a warning signal. Such warning signal can be visual and is optionally combined with an acoustic warning. The visual warning can be displayed on a touch screen of the lifting system and/or on a central controller and/or using another strategically located visualization element such as a light.

BRIEF DESCRIPTION OF THE DRAWINGS

Further advantages, features and details of the invention will be elucidated on the basis of preferred embodiments thereof, wherein reference is made to the accompanying drawings, in which.

DESCRIPTION OF THE INVENTION

Figure 1:
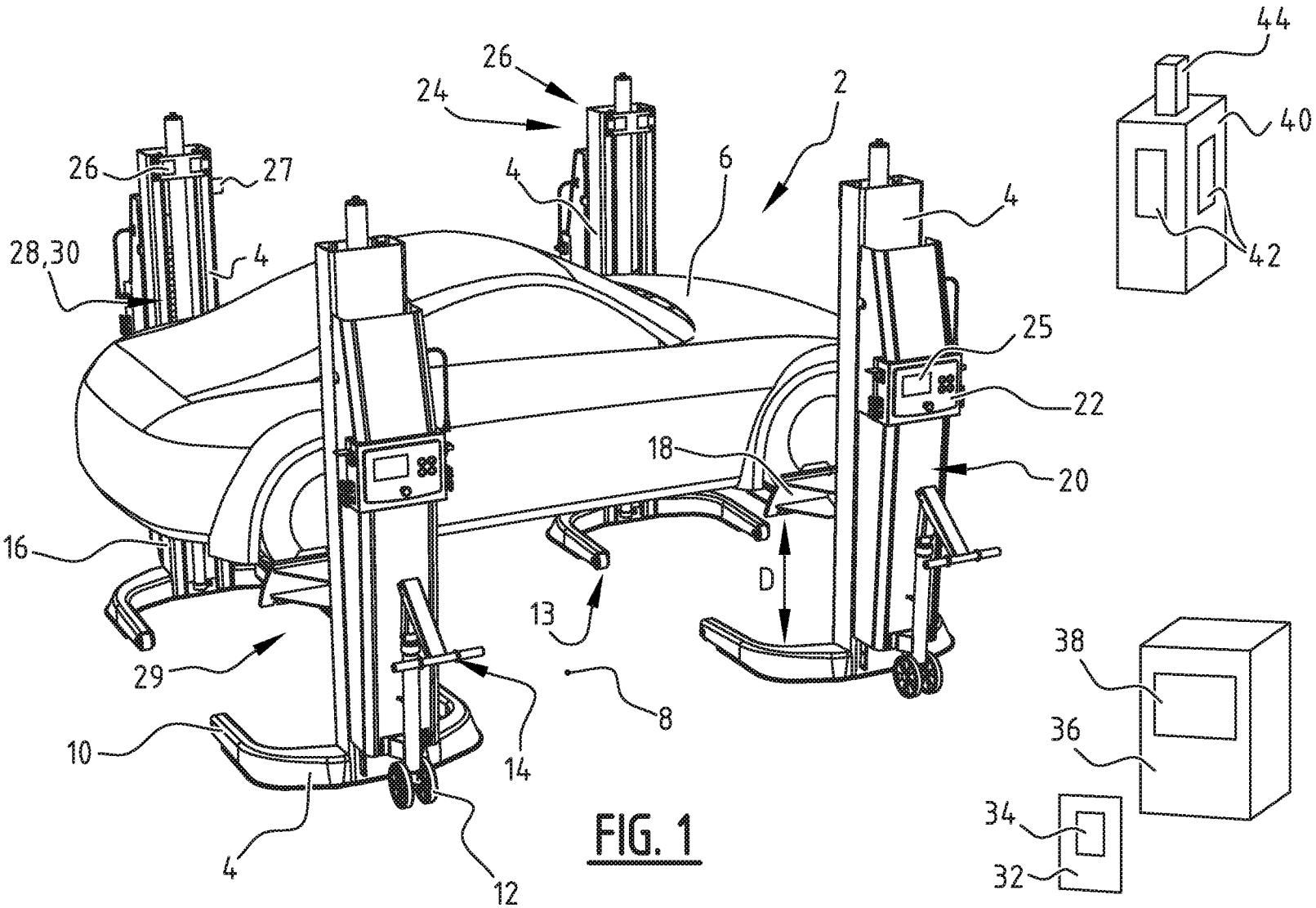
FIG. 1 shows a lifting system comprising a number of mobile lifting columns according to the present invention.

The following description is merely exemplary in nature and is in no way intended to limit the invention, its application, or uses. While the disclosure is described as having exemplary attributes and applications, the present disclosure can be further modified. This application is therefore intended to cover any variations, uses, or adaptations of the disclosure using its general principles. Further, this application is intended to cover such departures from the present disclosure as come within known or customary practice of those skilled in the art to which this disclosure pertains and which fall within the limits of the appended claims. Accordingly, the following description of certain embodiments and examples should be considered merely exemplary and not in any way limiting.

System 2 for efficient lifting and lowering load 6 (FIG. 1) comprises four wireless mobile lifting columns 4. Lifting columns 4 lift passenger car 6 from ground 8. In the illustrated embodiment lifting columns 4 are connected to each other and/or a control system by wireless communication means, or alternatively by cables. Lifting columns 4 comprise foot 10 which can travel on running wheels 12 over ground surface 8 of for instance a floor of a garage or workshop. In the forks of foot 10 is provided an additional running wheel 13. Running wheel 12 is part of pallet truck mechanism 14 enabling easy maneuvering of lifting column 4. Lifting column 4 furthermore comprises mast 16. Carrier 18 is moveable upward and downward along mast 16. Optionally, adapters can be used to adjust carrier 18 to specific wheel dimensions. Carrier 18 is driven by motor/drive system 20 that is preferably provided in a housing of lifting column 4. System 20 is supplied with power from the electrical grid or by a battery that is provided on lifting column 4 in the same housing as system 20, for example. In the illustrated embodiment lifting column 4 is further provided with control panel 22 to allow the user of system 2 to control the system, for example by setting the speed for carrier 18. In one embodiment, the motor of system 20 is a 3-phase low voltage motor controlled by a separate controller. In another embodiment, the motor of system 20 is a 3-phase low voltage motor with integrated controller. Such motor with integrated controller can also be used in combination with conventional lifting devices with conventional height measurement systems.

Each of the lifting columns has at least one ascent mode and one descent mode, and is under the influence of integrated controller with control panel 22. Controller 22 can be designed for each lifting column 4 individually, or for lifting system 2 with the lifting columns 4 together.

In the illustrated embodiment height sensing system 24 comprises height sensor 26, and optionally vehicle detector 27. It will be understood that alternative sensors can be used in combination or as an alternative. Furthermore, the illustrated embodiment shows lock sensor 28. Lock sensor 28 detects/measures the status of locking mechanism 30. Optional load sensor 29 detects the presence of a load and/or the actual load that is supported by carrier 18. Pressure or load sensor 29 may be used for monitoring, control and indication of the correct positioning of the load that is lifted with lifting system 2. Sensor signals are provided to controller 22.

In the illustrated embodiment controller 2 is provided with display 25. In addition, or as an alternative, remote control 32 with display 34 and/or central controller 36 with display 38 can be provided. Preferably, displays 25, 34, 38 are touchscreens. Light 40 is schematically illustrated and is provided with one or more signaling lights 42, preferably LED lights. Optionally, acoustic signal generator 44 is provided to assist the signaling function of light 40. It will be understood that light 40 and generator 44 can be positioned at or adjacent system 2 and/or at a central location in a workshop, for example.

Figure 2A:
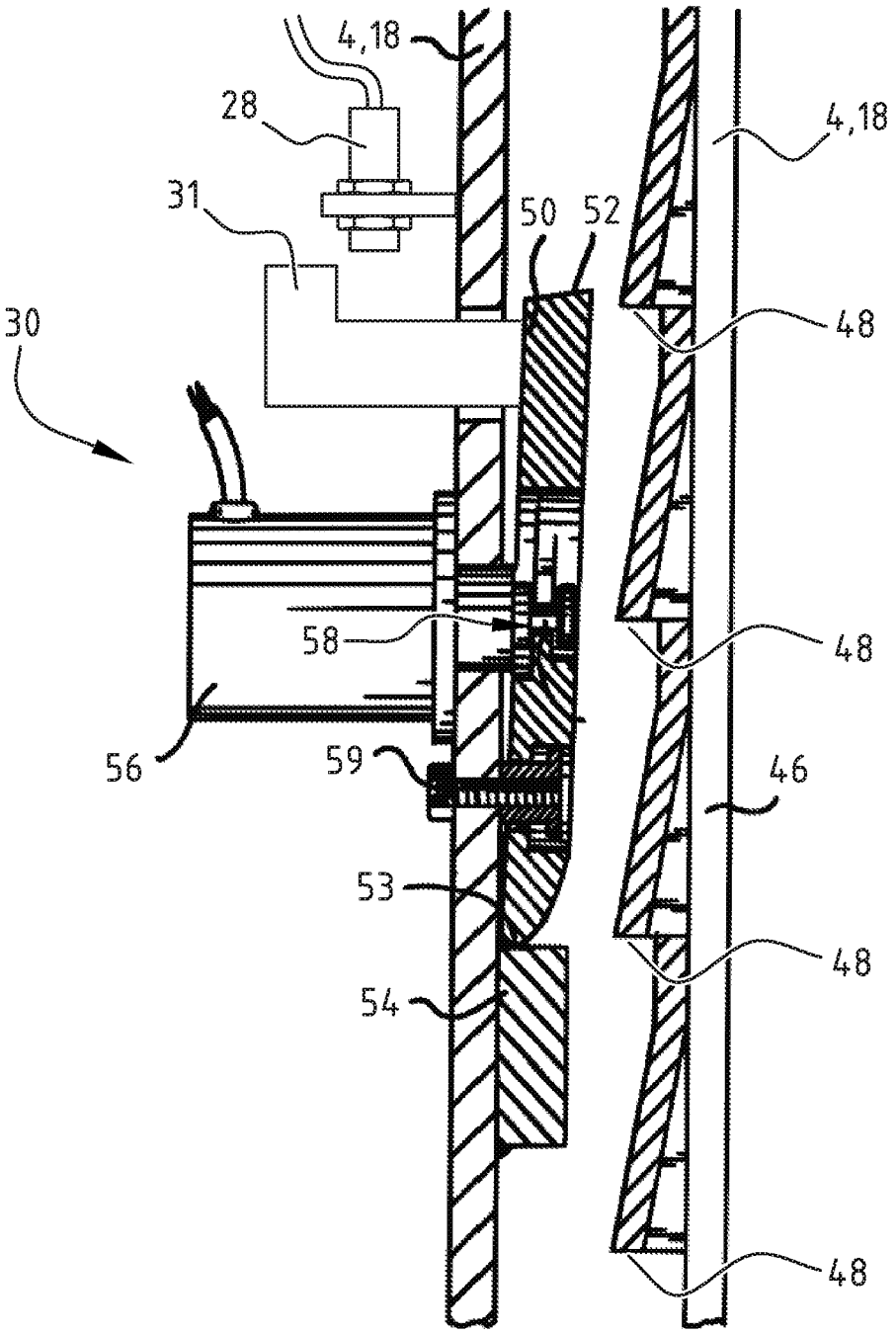
FIGS. 2A-C schematically show a locking mechanism that can be applied to a lifting device according to the invention.

Locking mechanism 30 (FIG. 2A) is schematically illustrated and comprises in this illustrated embodiment rail 46 with supporting surfaces 48. Locking element 50 is provided with support surface 52. In a locked position, support surface 52 of pawl 50 engages one of the supporting surfaces 48 of rail 46. On the other side of locking element 50 a secondary support surface 53 can be supported by support 54. Lock actuator 56 acts as drive for locking element 50 and moves element 50 between a locked state and an unlocked state using plunger or shaft 58, with bolt 59 allowing the movement between both states. It will be understood that an alternative locking mechanism 30 can also be envisaged in accordance with the present invention. In the illustrated embodiment lock sensor 28 comprises an inductive sensor that measures the position of cam 31. In a first embodiment rail 46 is provided on carrier 18 and locking element 30 is provided on frame 4 of lifting device 2. In a second embodiment rail 46 is provided on frame 4 of lifting device 2 and locking element 30 is provided on carrier 18.

Figure 2B:
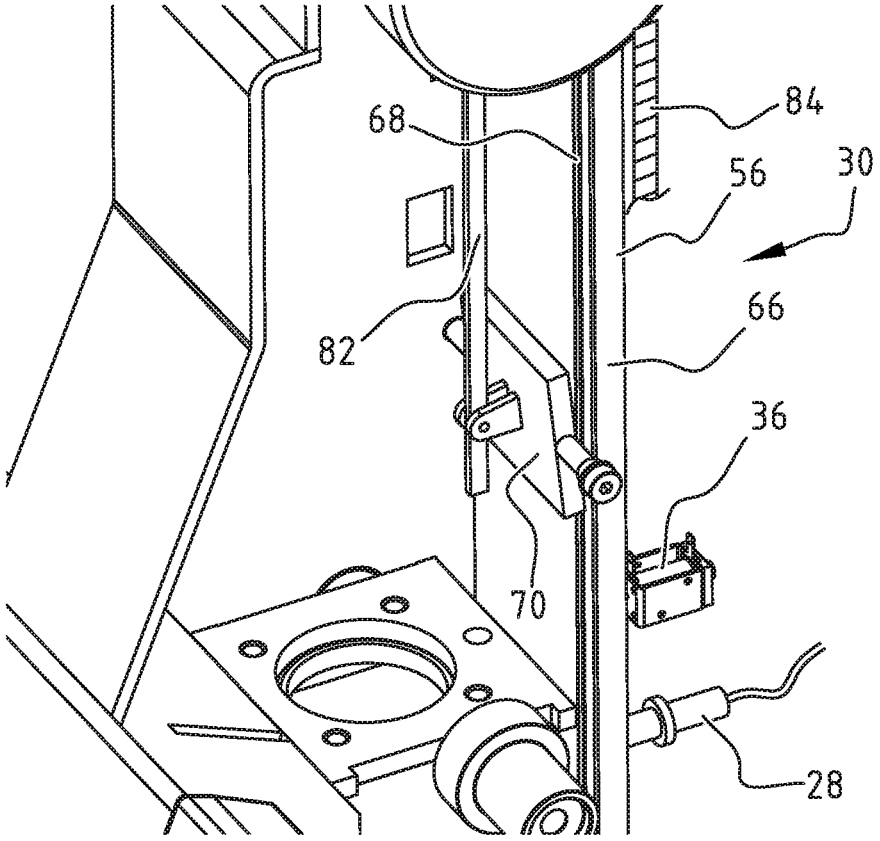
Figure 2C:
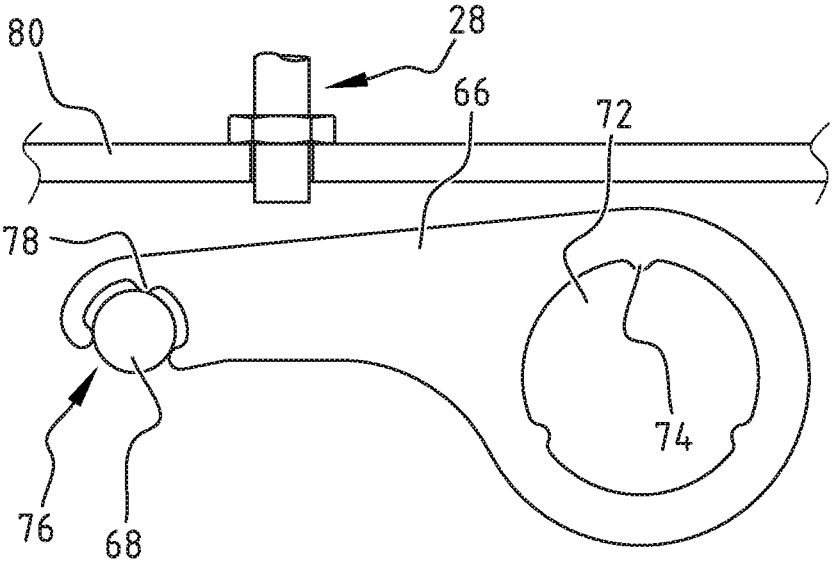

In a further embodiment (FIGS. 2B-C) locking mechanism 30 with lock actuator 56 comprises aluminium profile or frame 66 and polyethylene anti-wear strip 68 that may contact block 70. In the illustrated embodiment lock actuator 56 comprises an electromagnet 36.

Profile 66 (FIG. 2C) comprises hole or opening 72 with a number of protrusions or nocks 74. The other end profile frame 66 is provided with hole or opening 76 having a number of protrusions or nocks 78, with hole 76 capable of receiving PE strip 68. Sensor 28 is attached to plate or frame 80 of the lifting system and is capable of detecting the position of profile 66. Locking mechanism 30 activates lock actuator 56 that extends over a substantial part of the length or height of mast 16 such that lock actuator 56 rotates, with lock actuator 56 comprising profile 66 and anti-wear strip 68. Lock actuator 56 rotates between a locked state and an unlocked state. Block 70 is provided at or on moveable carrier 18 and is configured for engaging and/or disengaging locking rail 84 in response to the movement of actuator 56. Lock actuator 56 is pivotally connected at its outer ends to mast 16 or other parts of the lifting device. When rotating lock actuator 56 block or pawl 70 will engage or disengage from locking rail 84 that preferably extends along mast 16. As a further advantage, as the length of lock actuator 56 substantially corresponds to the length of the stroke of the cylinder that moves carrier 18, carrier 18 can be locked at any desired height along mast 16. This further improves the operation of lifting device of the present invention. Preferably, in case of a power failure, the electromagnet 36 of lock actuator 56 is turned off and profile 52 returns to its inactive position wherein block 70 engages locking rail 84. Optionally, a user may manually operate rod 82 to disengage block 70 from locking rail 84 to lower carrier 18, for example. This contributes to providing a safe working environment with an effective lifting device.

It will be understood that other embodiments or configurations for locking mechanism 30 can also be envisaged in accordance with the present invention.

Figure 3:
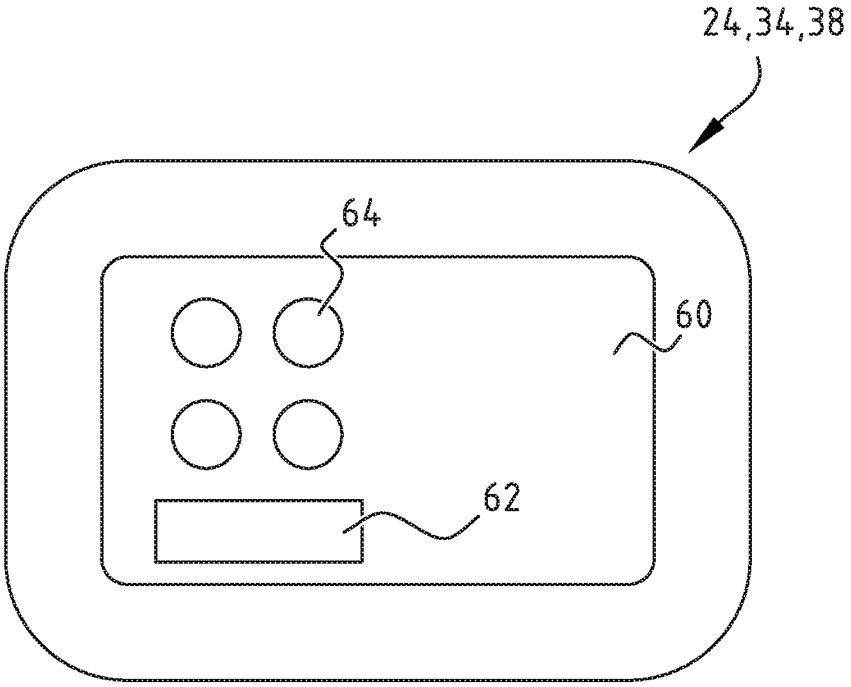
FIG. 3 shows a display that can be used in a lifting device according to the present invention.

Display 25, 34, 38 (FIG. 3) schematically shows screen background 60, text box 62 and visual elements 64 that represent lifting devices 2. With changing colours and/or text, elements 60, 62, 64 indicate a safe or unsafe situation, optionally assisted by light 40 and/or generator 44.

When lifting vehicle 6 the vehicle is positioned relative to carriers 18. When raising carriers 18 relative to frame 4 of mobile lifting columns the actual height is preferably measured with a type of height sensor 26. When the desired height is reached and all carriers 18 are equally positioned, in the illustrated embodiment the carriers 18 are lowered into their lock with locking mechanism 30. This requires changing of the actual position of locking element 50 that can be detected by sensor 28. The signal of sensor 28 is preferably provided to controller 22 that enables a visual indication of display 25,34,38, optionally assisted by further assisting signals with light 40 and acoustic generator 44.

Optionally, a central controller 36, remote control 32, chief operator etc. is provided with the measurement signal. Visualization of a safe or unsafe working situation can be performed by changing the color of the screen background 60 and/or indicating in text box 62 that all columns are safe to use. Screen background 60 helps a user to be informed of a safe or unsafe situation even from a distance. The condition of individual columns can be provided with visual elements 64, for example.

For example, green background color indicates a locking situation wherein a user can perform operations on vehicle 6, while a red background indicates an unsafe situation and an orange background indicates that some but not all lifting devices are locked. It will be understood that other configurations can also be envisage in accordance with the invention.

The present invention can be applied to the (wireless) lifting columns illustrated in FIG. 1. Alternatively, the invention can also be applied to other types of lifting columns and lifting systems with the use of locking mechanism 30, sensor 28 and display 25. It will be understood that parts/elements can be exchanged between the different illustrated embodiments.

Figure 4:
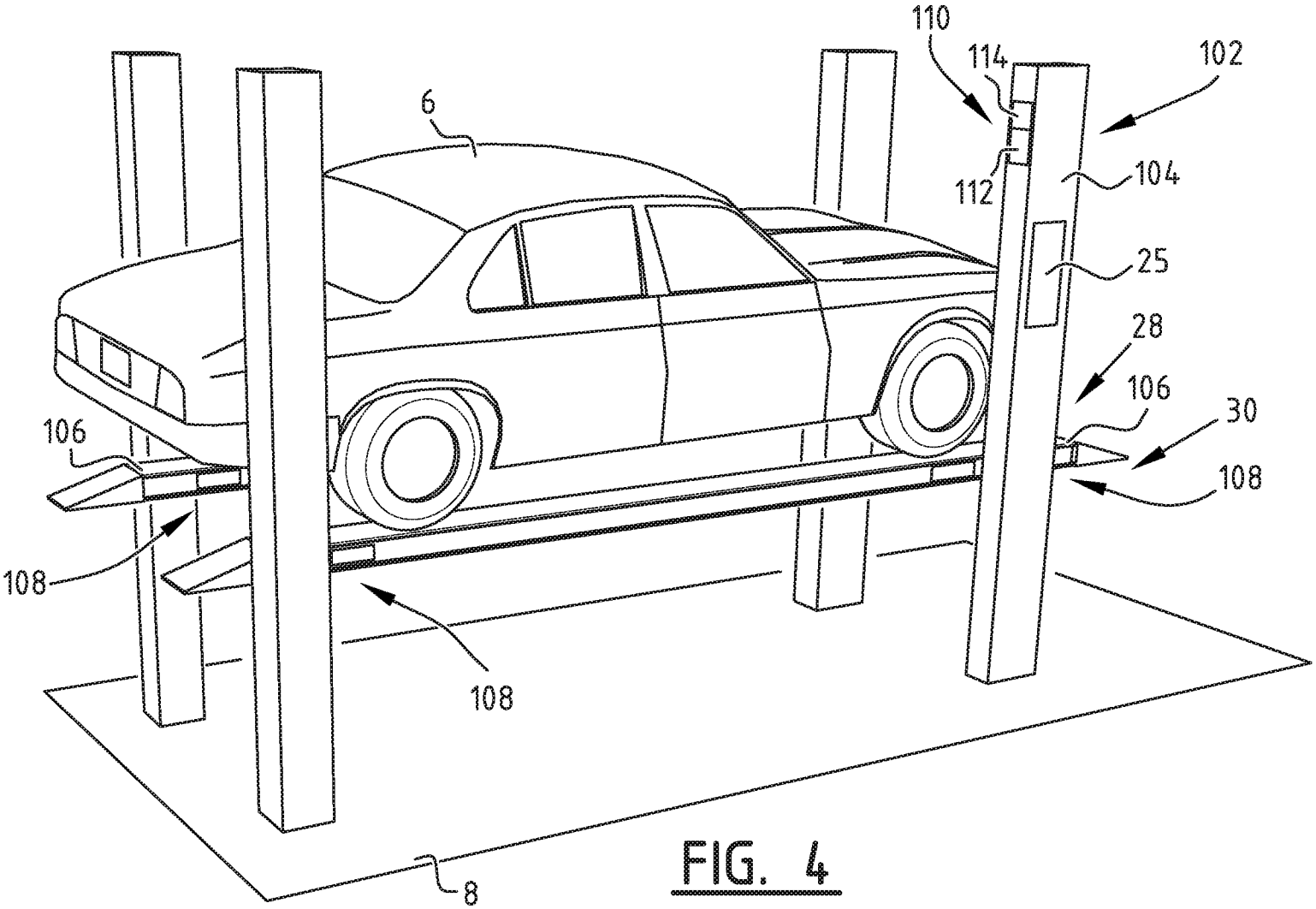
FIGS. 4-6 show alternative embodiments of lifting systems according to the invention.

For example, a four-post lifting system 102 (FIG. 4) comprises four columns 106 carrying runways 106. Columns 104 comprise a sensor 108, preferably each column 104 has one sensor 108. In the illustrated embodiment an indicator 110 with a green light 112 and a red light 114 is provided. Light 110 signals to the driver when vehicle 6 is positioned correctly relative to columns 104 and the vehicle 6 can be lifted. In case each column 104 is provided with sensor 108 the position of carrier 106 can be checked. This contributes to the overall safety of the lifting operation.

Figure 5:
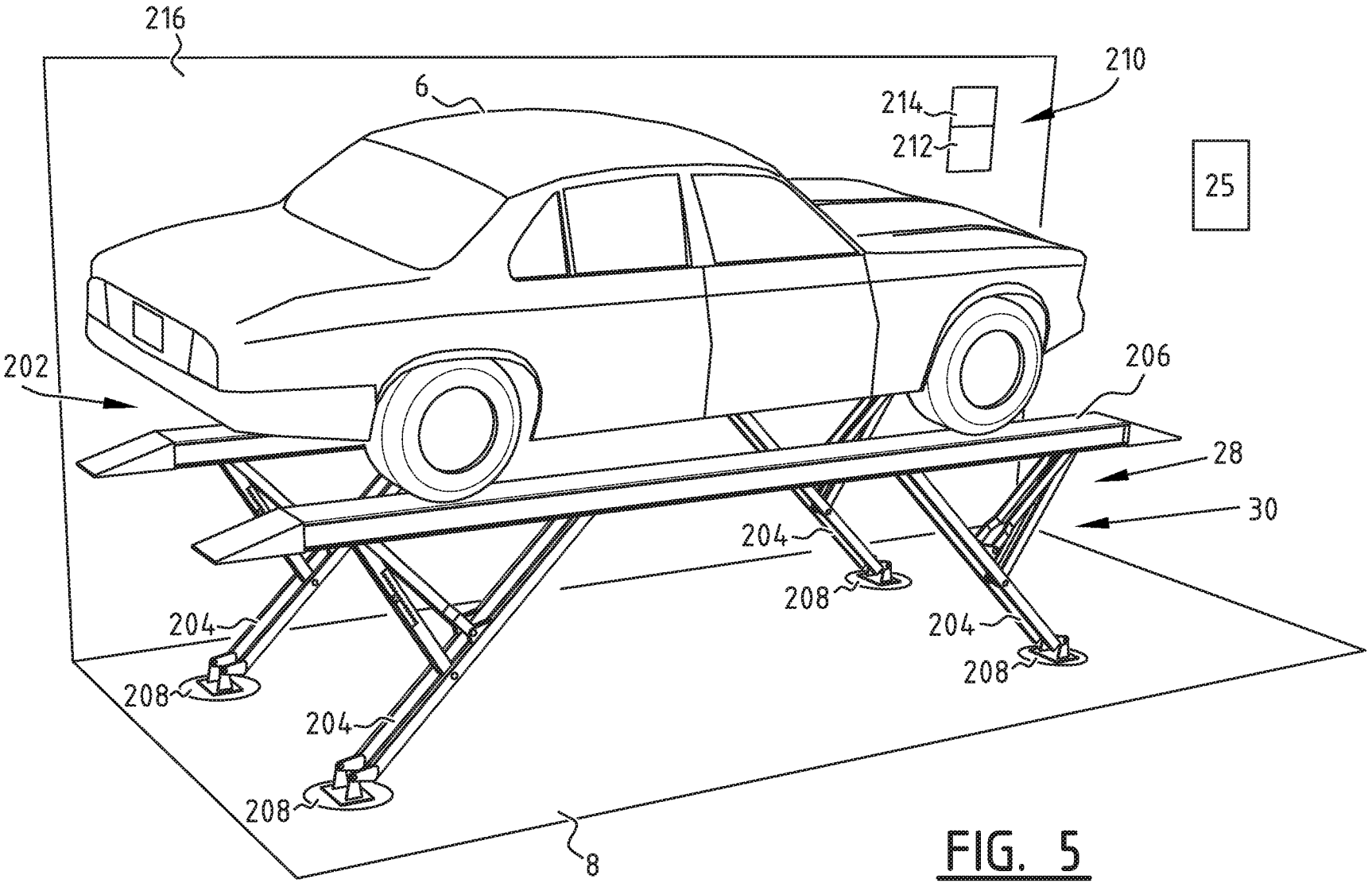

As a further example, lifting system 202 (FIG. 5) comprises a so-called sky-lift configuration with four posts 204 carrying runways 206. In the illustrated embodiment a sensor 208 is provided for every post 204. This enables the check on positioning of the carrier as described earlier. A light 210 with green 212 and red 214 lights can be provided on wall 216 to indicate to the driver of vehicle 6 that the vehicle is positioned correctly or needs to be repositioned.

Figure 6:
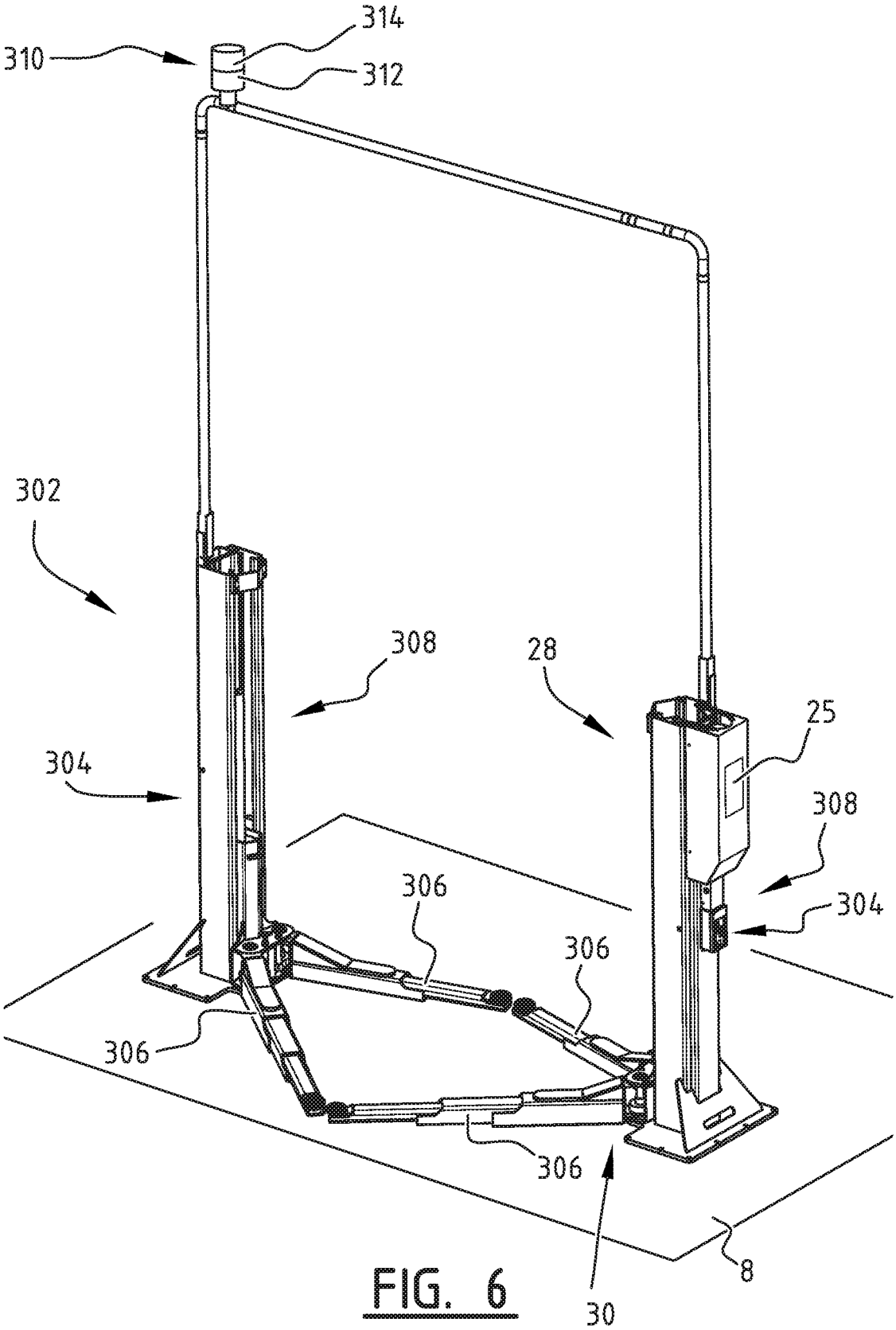

As an even further example, lifting system 302 (FIG. 6) comprises a so-called two-post configuration with two posts 304 that are provided with carrier arms 306. In the illustrated embodiment to measure position and speed of carrier arms 306 sensor 308 is provided. This enables the check on positioning of arms 306 as described earlier. A light 310 with green 312 and red 314 lights can be provided to indicate to the driver of vehicle 6 that the vehicle is positioned correctly or needs to be repositioned.

Figure 7A:
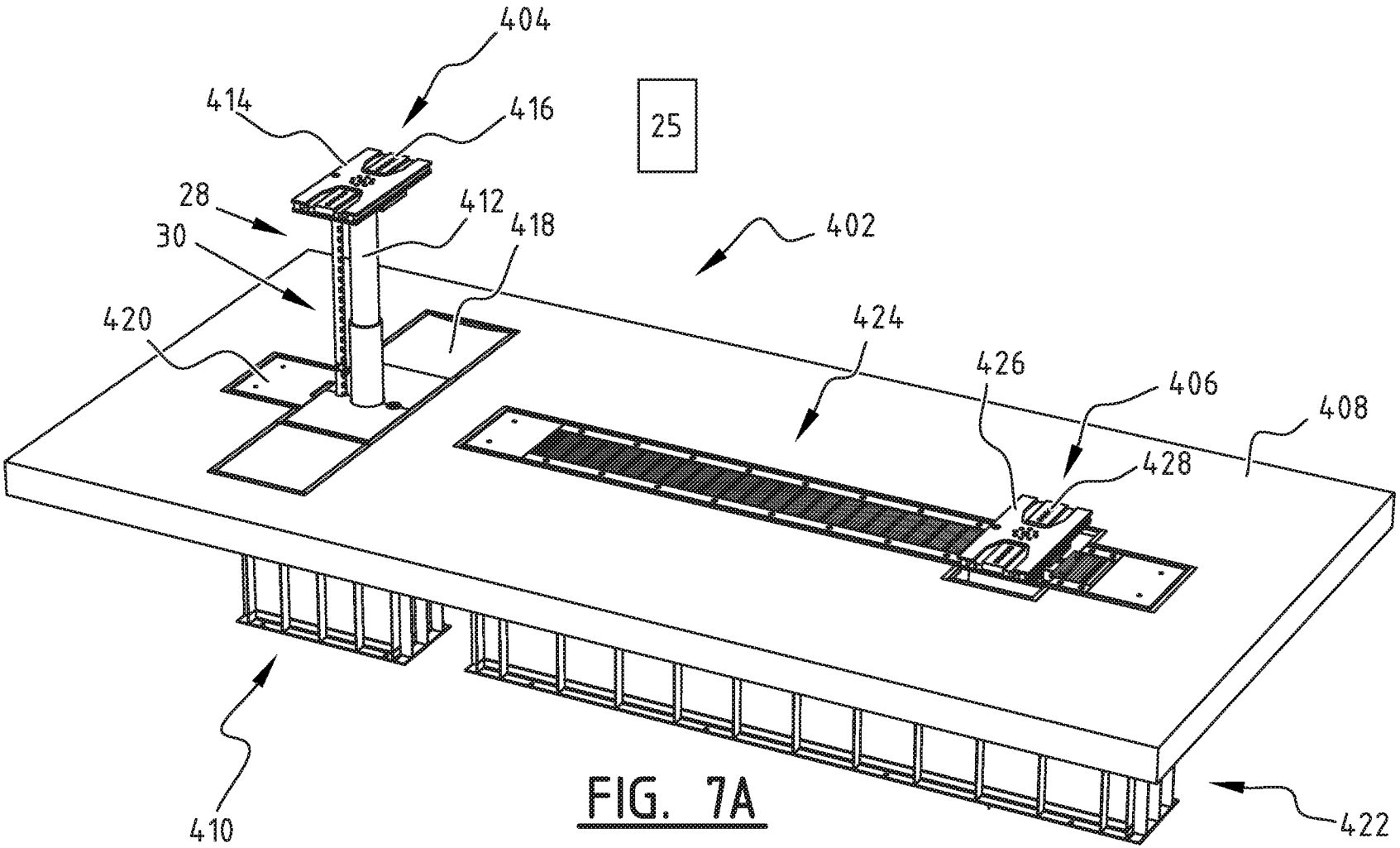
FIGS. 7A-B and 8 show further alternative in-ground embodiments of lifting systems according to the invention.
Figure 7B:
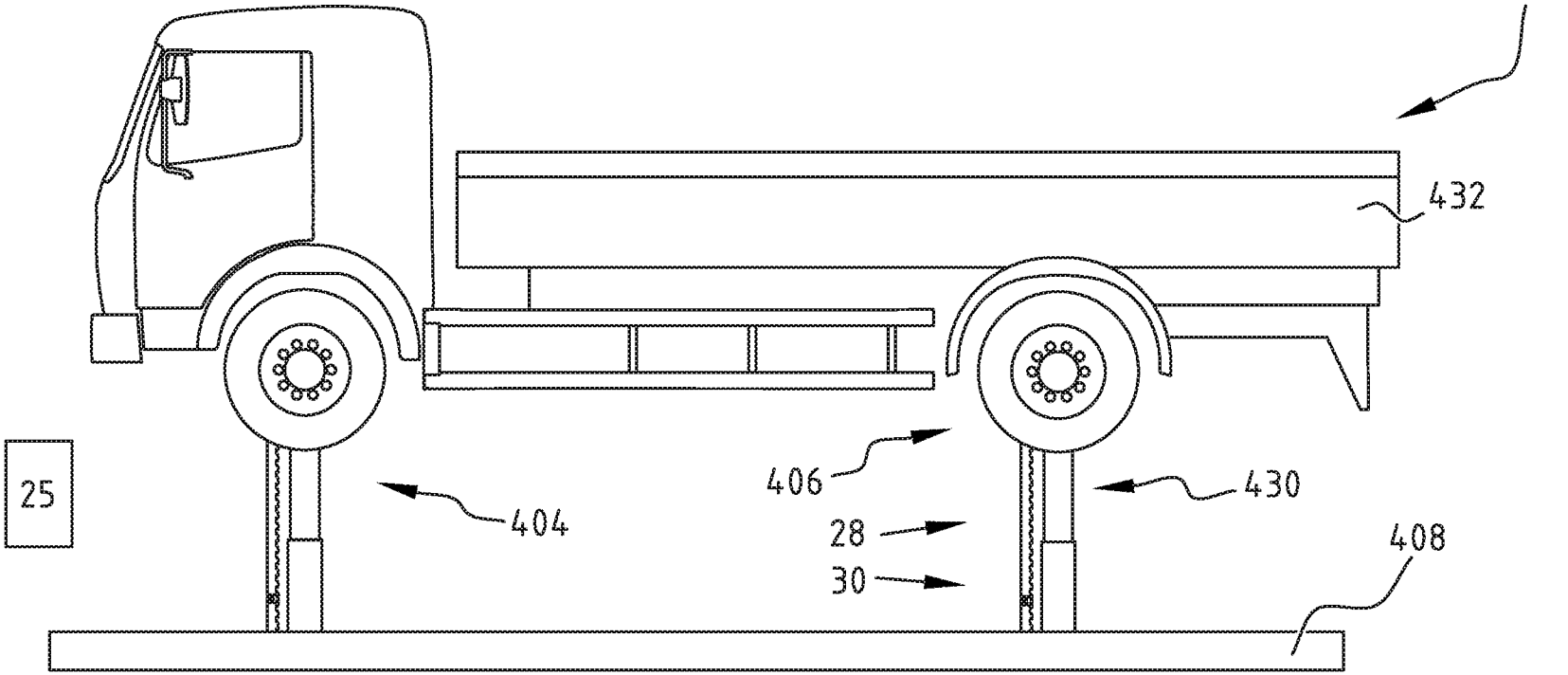

In a further alternative embodiment lifting system 402 (FIG. 7 A-B) is of the in-ground lift type comprising stationary lifting column/device 404 and a moveable lifting column/device 406 that are located on or in floor 408. The front lifting column/device 404 is provided in cassette or box 410 with a telescopic lifting cylinder 412. On top of cylinder 412 there is provided carrier 414 with axle carriers 416. In the illustrated embodiment wheel edges or wheel recesses 418 are provided. Recesses 418 define the position of the front wheels of the vehicle. Furthermore, in the illustrated embodiment a hatch 420 is provided in front of the front lifting column/device 404 for maintenance, for example.

The moveable lifting column/device 406 moves in cassette or box 422 comprising a telescopic lifting cylinder 430. Box 422 provides a pit with a slot or recess 424 for guiding the moveable lifting column/device 406. Moveable lifting column/device 406 is provided with carrier 426 whereon axle carriers 428 are mounted. Depending on the type of vehicle 432 additional adapters can be provided that cooperate with carriers 414, 426 to enable engagement with different axle dimensions.

Figure 8:
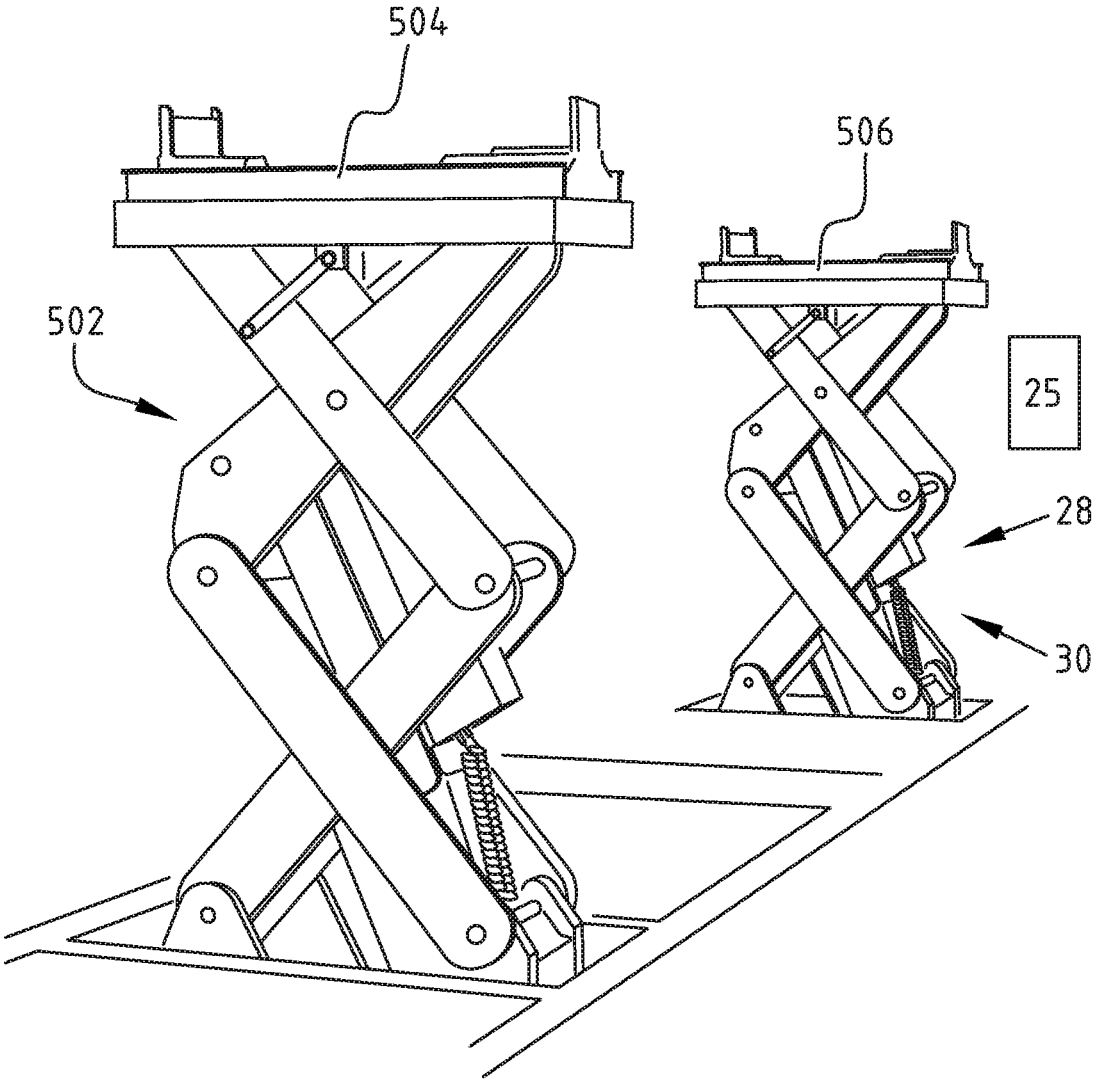

In an alternative lifting system 502 of the in-ground type (FIG. 8) the telescopic lifting cylinders 412, 430 of lifting system 402 are replaced by scissor type lifts 504, 506. It will be understood that operation of lifting systems 402, 502 of the in-ground type is similar.

It will be understood that the invention can be applied to a range of lifting systems, including but not limited to four-post and two-post lifting columns, such as the Stertil-Koni one post lifts ST1075, the Stertil-Koni two post lifts SK 2070, and the Stertil-Koni four post lifts ST 4120, skylift, mobile columns, and in-ground lifts, such as the Stertil in-ground Ecolift and the Stertil in-ground Diamond lift. Also, it will be understood that additional embodiments of the invention can be envisaged combining and/or switching features from the described and/or illustrated embodiments. For example, instead of light 110, 210, or in addition thereto, sound signals, indications on a control system etc. can be applied.

These further examples of lifting devices/systems may use locking mechanism 30 that is illustrated in more detail in relation to lifting system 2.

The present invention is by no means limited to the above described preferred embodiments. The rights sought are defined by the following claims within the scope of which many modifications can be envisaged. The present invention is described using a lifting device such as a lifting column and more specifically a mobile lifting column. The invention can also be applied to other type of lifting columns such as so-called boom-lifts, scissor-lifts and loading platforms. Such lifting equipment can be provided with the measures illustrated above according to the invention.

The invention claimed is:

1. A lifting device for lifting a vehicle, the lifting device comprising:

a frame with a moveable carrier that is configured for carrying the vehicle;

a drive which acts on the carrier and is configured for raising and/or lowering the carrier relative to the frame;

a height sensing system that is configured for directly and/or indirectly measuring the height of the carrier;

a locking mechanism for mechanically locking the carrier at a desired height comprising a moveable locking element capable of locking and unlocking the carrier; and a display and a connector for connecting the lock sensor to the display to enable displaying of a status of the locking element, wherein the locking mechanism comprises a lock sensor for measuring the position of the locking element.

2. The lifting device according to claim 1, wherein the locking element comprises a locking pawl.

3. The lifting device according to claim 1, wherein the lock sensor comprises a position indicator.

4. The lifting device according to claim 1, wherein the display is one or more of a display of the lifting device such as a touch screen, a display on a remote control, and a central display.

5. The lifting device according to claim 1, further comprising a controller that is connected to the lock sensor and is configured to enable and/or disable operation of the lifting device based on a signal received from the lock sensor.

6. The lifting device according to claim 5, wherein the controller further comprises a warning system configured for providing a warning signal and/or a control signal in response to a detected unsafe situation.

7. The lifting device according to claim 1, further comprising a vehicle detector.

8. A lifting system for lifting a vehicle, the lifting system comprising a plurality of lifting devices according to claim 1.

9. The lifting system of claim 8, further comprising a central display configured for displaying the status of the locking elements of the plurality of lifting devices.

10. The lifting system of claim 8, further comprising a central controller that is configured to enable and/or disable operation of the lifting system based on signals received from the lock sensors of the plurality of lifting devices.

11. A method for lifting a vehicle, the method comprising:

providing a lifting device according to claim 1;

measuring the position of the locking element with the locking sensor;

determining the status of the locking mechanism and providing the status to a display; and displaying the status of the locking mechanism based on measuring the position of the locking element with the locking sensor.

12. The method according to claim 11, further comprising enabling and/or disabling operation of the lifting device, and after enabling of a lifting operation of the vehicle.

13. The method according to claim 11, further comprising detecting an unsafe situation and providing a warning signal.

14. The lifting device according to claim 2, wherein the lock sensor comprises a position indicator, further comprising a display and a connector for connecting the lock sensor to the display to enable the display of the status of the locking element.

15. The lifting device according to claim 14, further comprising a controller that is connected to the lock sensor and is configured to enable and/or disable operation of the lifting device based on the signal received from the lock sensor.

16. The lifting device according to claim 15, wherein the controller further comprises a warning system configured for providing a warning signal and/or control signal in response to a detected unsafe situation.

17. The lifting device according to claim 14, further comprising a vehicle detector.

18. The lifting system of claim 9, further comprising a central controller that is configured to enable and/or disable operation of the lifting system based on signals received from the lock sensors.

19. The method according to claim 12, further comprising detecting an unsafe situation and providing a warning signal.

* * * * *